US006380919B1

(12) United States Patent
Koyama et al.

(10) Patent No.: US 6,380,919 B1
(45) **Date of Patent: *Apr. 30, 2002**

(54) ELECTRO-OPTICAL DEVICES

(75) Inventors: Jun Koyama, Kanagawa; Shunpei Yamazaki, Tokyo, both of (JP)

(73) Assignee: Semiconductor Energy Laboratory Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/757,929

(22) Filed: Nov. 27, 1996

(30) Foreign Application Priority Data

Nov. 29, 1995 (JP) ..... 7-336054

(51) Int. Cl.[7] ..... G09G 3/36

(52) U.S. Cl. ..... 345/92; 345/96; 345/98; 345/100

(58) Field of Search ..... 345/96, 87, 55, 345/92, 112–116, 98, 100; 356/236, 92; 349/48

(56) References Cited

U.S. PATENT DOCUMENTS

| | | | | | |
|---|---|---|---|---|---|
| 4,338,600 | A | * | 7/1982 | Leach | 345/101 |
| 4,393,405 | A | | 7/1983 | Ikeda | |
| 4,745,485 | A | * | 5/1988 | Inasaki | 345/121 |
| 4,822,142 | A | * | 4/1989 | Yasui | 349/48 |
| 4,870,493 | A | * | 9/1989 | Izawa et al. | 348/305 |
| 4,922,240 | A | * | 5/1990 | Duware | 345/96 |
| 5,051,739 | A | | 9/1991 | Hayashida et al. | |
| 5,091,722 | A | * | 2/1992 | Kitajima et al. | 345/89 |
| 5,093,655 | A | * | 3/1992 | Tanioka et al. | 345/96 |
| 5,369,417 | A | * | 11/1994 | Tanaka | 345/100 |
| 5,642,129 | A | * | 6/1997 | Zavracky et al. | 345/100 |
| 5,748,165 | A | * | 5/1998 | Kubota et al. | 345/96 |
| 5,781,164 | A | * | 7/1998 | Jacobson et al. | 345/87 |
| 5,844,538 | A | * | 12/1998 | Shiraki et al. | 345/98 |

FOREIGN PATENT DOCUMENTS

| | | |
|---|---|---|
| JP | 57041078 | 3/1982 |
| JP | 62265696 | 11/1987 |
| JP | 63073295 | 4/1988 |
| JP | 3-78726 | 4/1991 |
| JP | 7-66252 | 7/1995 |
| JP | 7-66256 | 7/1995 |

* cited by examiner

*Primary Examiner*—Almis R. Jankus
*Assistant Examiner*—Amr Awad
(74) *Attorney, Agent, or Firm*—Fish & Richardson, P.C.

(57) ABSTRACT

In a display device comprising a plurality of pixels arranged in matrix form, there are provided two or more row driving and/or column driving circuits aligned parallel to each other. This arrangement serves to reduce intervals between rows and/or columns driven by each of the parallel driving circuits so that the pixels of the matrix can be arranged at a higher density. With this parallel arrangement of the driving circuits, interlaced scanning as well as line inversion and dot inversion of video signals are simplified and the operating frequency of the driving circuits can be reduced.

12 Claims, 11 Drawing Sheets

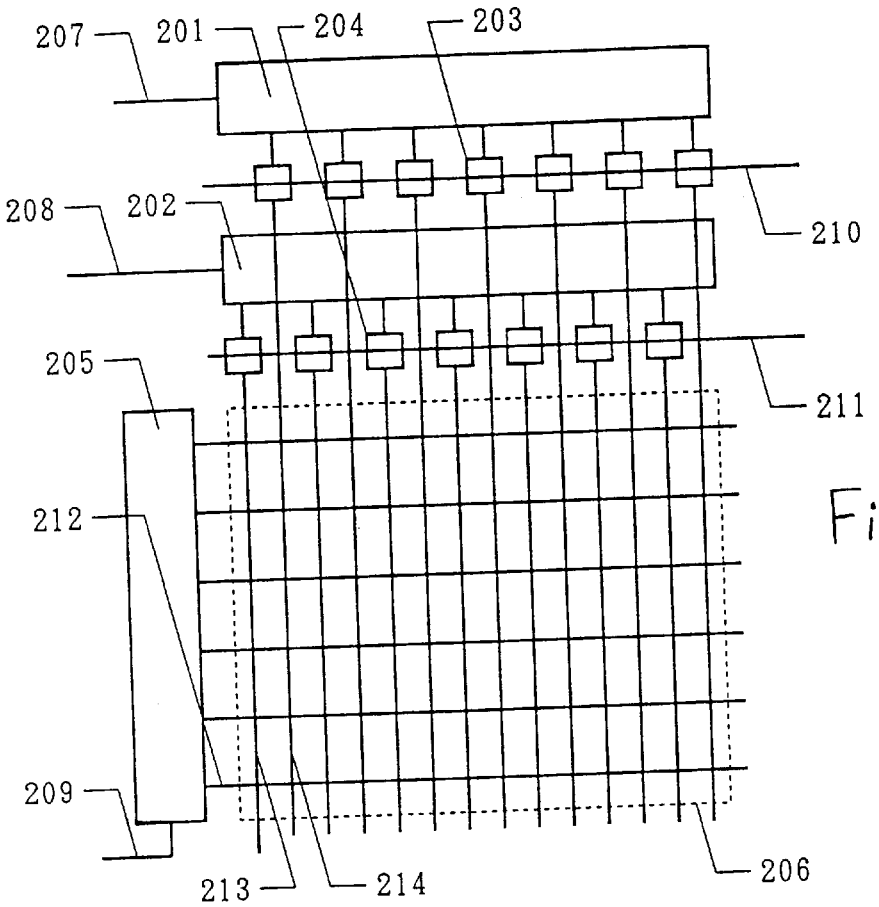
Fig. 2(A)
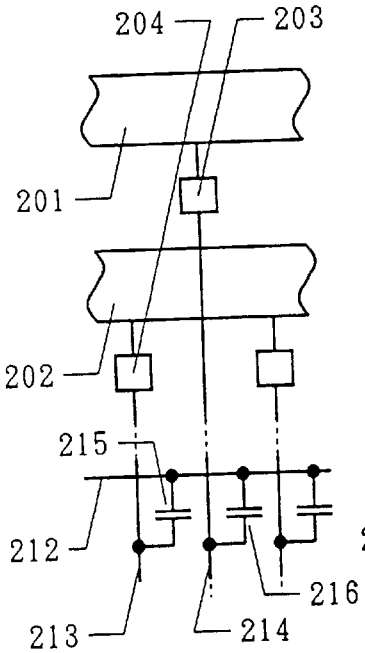
Fig.2( B )
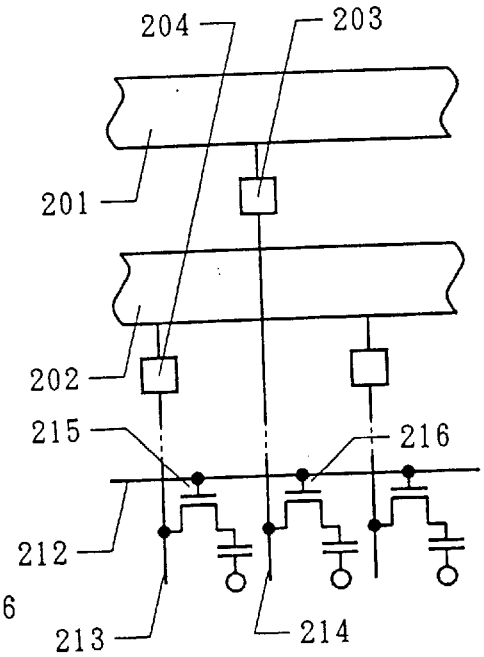
Fig.2( C )

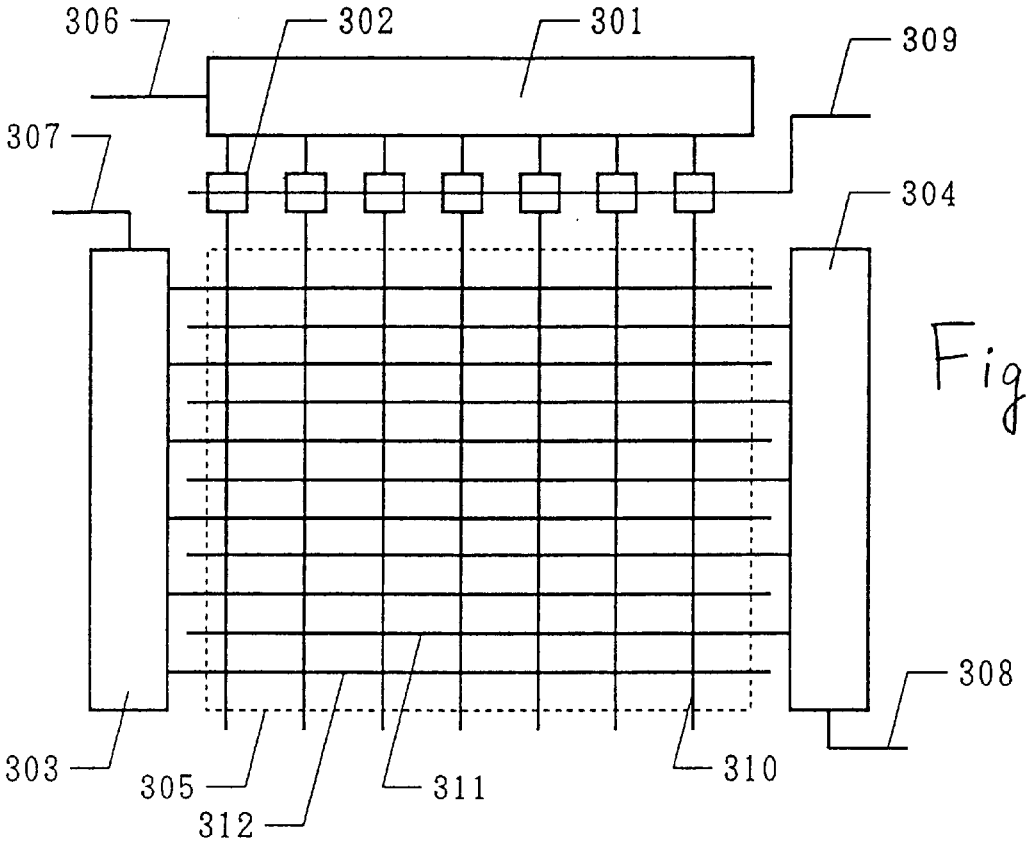
Fig.3(A)
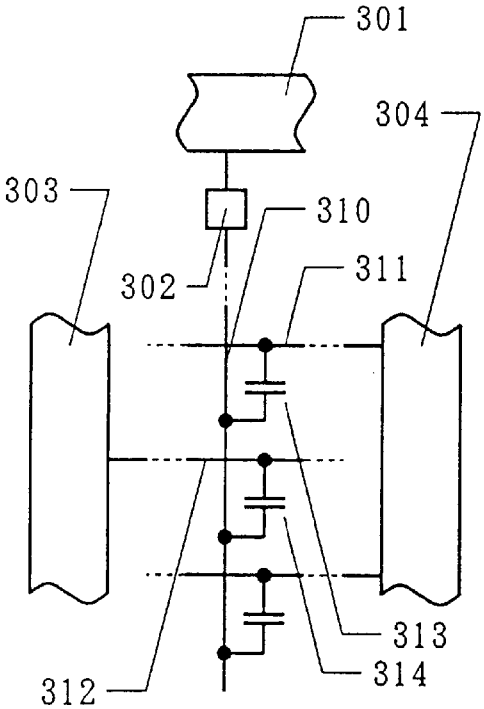
Fig.3( B )
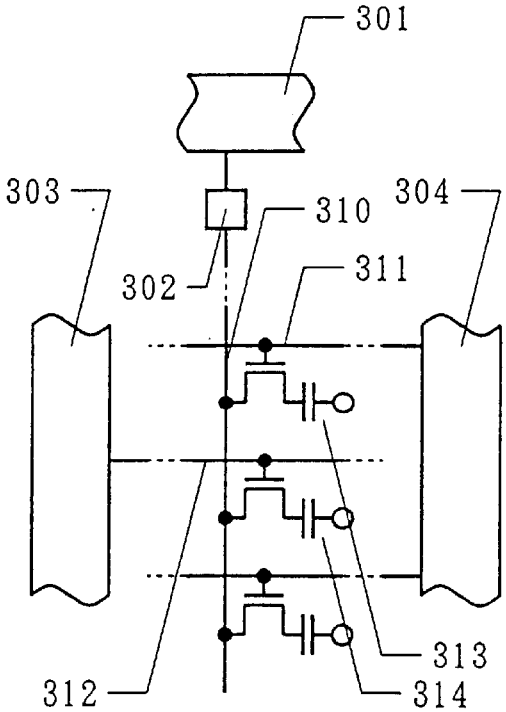
Fig.3( C )

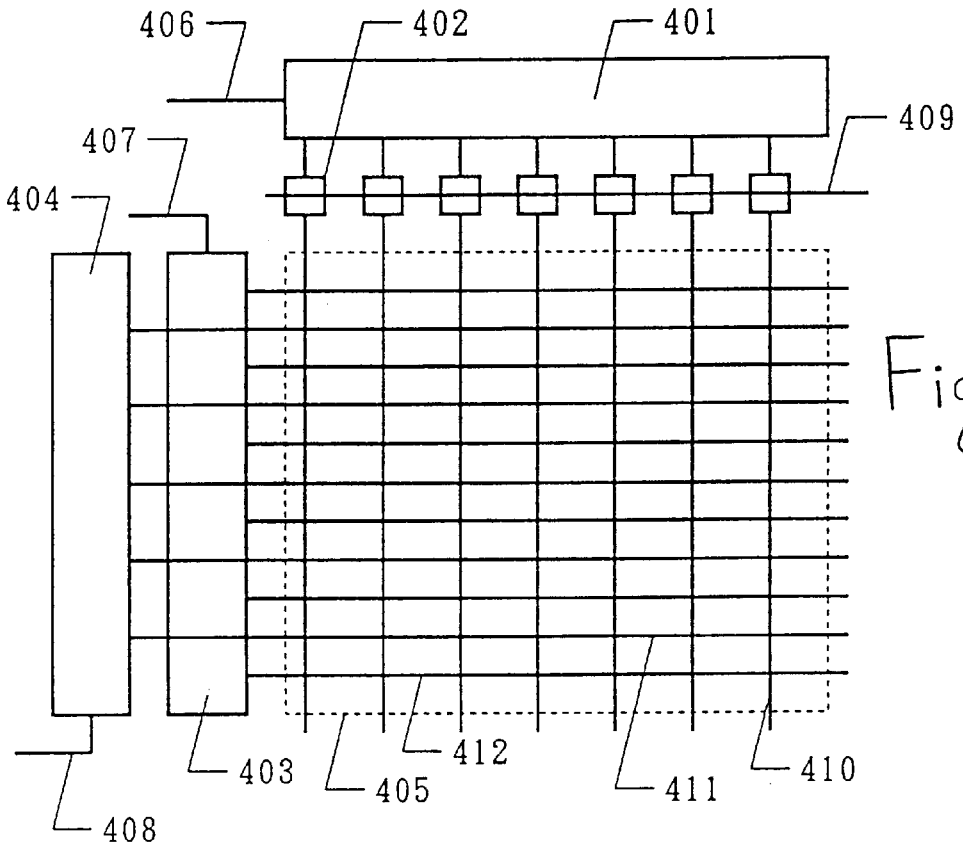
Fig. 4(A)
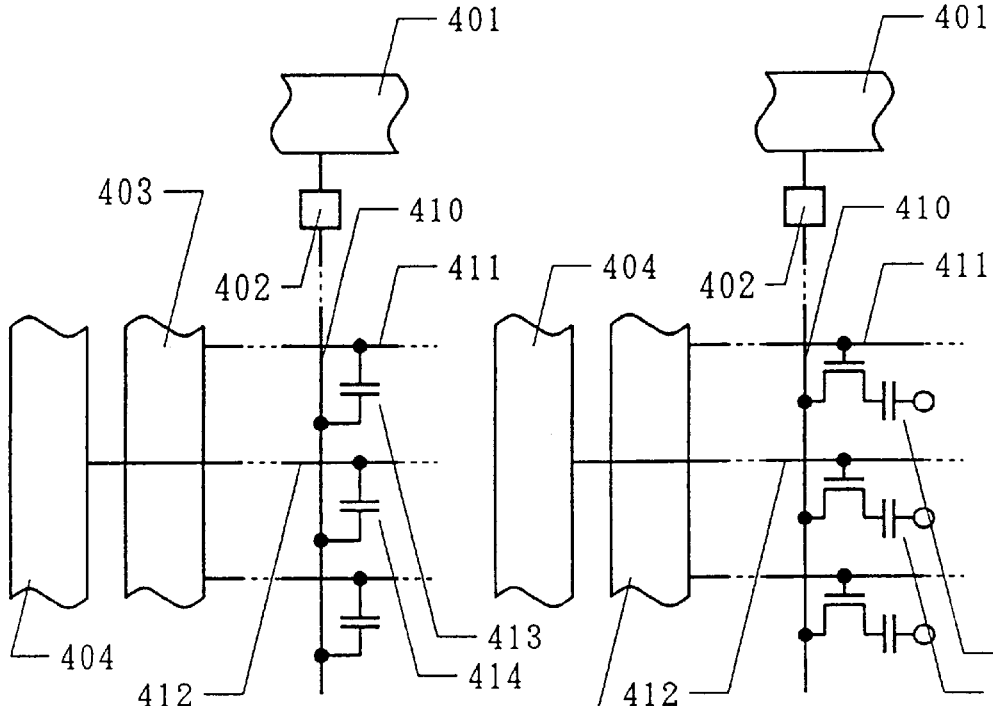
Fig.4( B )
Fig.4( C )

ELECTRO-OPTICAL DEVICES

BACKGROUND OF THE INVENTION

1. Technical Field of the Invention

The present invention pertains generally to display devices and, more particularly, relates to driving circuits thereof. The invention can be applied to driving methods for either simple matrix or active matrix displays. The invention is also applicable to display devices including such flat-panel displays as liquid crystal displays (LCDs) and electroluminescent displays, in which light transmittance, reflectance, refractive index, luminous intensity or other properties are varied by applying electrical signals in a controlled manner, and not including cathode ray tubes (CRTs).

2. Description of the Related Art

Matrix display devices incorporating a plurality of display elements arranged in matrix form are employed particularly in flat-panel displays as large capacity display means. Conventionally known matrix display devices include simple matrix type in which individual display elements arrayed in rows and columns have no built-in actuating devices and active matrix type in which each individual display element is associated with an active device such as a transistor or a diode. In the following description, a column signal line refers to each signal line for transmitting an electrical signal which contains a video signal, and a row signal line refers to each signal line for transmitting an electrical signal which does not contain any video signal.

In either type of matrix display device, basic construction is such that peripheral driving circuits containing addressing circuits are arranged in the periphery of the matrix structure for providing signals to the row and column signal lines. These driving circuits are called the row driving circuit and column driving circuit. For example, Japanese Unexamined Patent Application No. 57-41078 discloses an arrangement employing a shift register as an addressing circuit for active matrix display devices, whereas Japanese Unexamined Patent Application No. 62-265696 discloses an arrangement employing a decoder including AND gates and NAND gates as an addressing circuit for active matrix display devices.

The peripheral driving circuit of the conventional, matrix display device used to be formed on an integrated semiconductor circuit of the prior art, and connected to the matrix structure formed on a glass substrate using such bonding technique as a tape automated bonding (TAB) operation. Spacings between individual row and column signal lines have decreased in recent years as a result of increasing demand for greater display capacity of matrix displays and more compact matrix structure. This necessitates that the peripheral driving circuit be formed on the same substrate as the matrix structure in monolithic form. It is difficult to connect the individual lines with line spaces of 100 $\mu$m or less by TAB technology since the TAB operation is based on application of mechanical pressure. In the aforementioned construction in which the peripheral driving circuit is formed on the same substrate as the matrix of display elements, it is possible to utilize photolithography. In an ideal case, photolithography enables reduction of line spacing to a level practically equal to the level of design rule requirements.

It has recently been recognized, however, that a reduction in the area of individual display elements could give rise to problems related to circuit configuration. More specifically, even when the peripheral driving circuit is formed on the same substrate as the matrix of display elements in monolithic form, a circuit for supplying electrical signals to individual signal lines should have such line widths that equal to or smaller than the spaces between the individual signal lines. As an example, each stage of a shift register contained in the peripheral driving circuit includes approximately 10 transistors, and it is essential that the circuit be designed in such a way that these transistors fall within widths of the individual signal lines. In a case where the circuit is designed based on a 5 $\mu$m design rule, for instance, permissible minimum width of each signal line is 30 $\mu$m and, therefore, dimensions of each display element become at least 30 $\mu$m by 30 $\mu$m.

According to prior art driving techniques for a matrix display device, its row signal lines are sequentially driven from top to bottom (or from bottom to top). This means that the conventional matrix display devices can not be operated by a commonly used interlaced scanning process, in which groups of odd-numbered horizontal lines and even-numbered horizontal lines are scanned in alternate vertical scans. This limitation of the matrix display devices is disadvantageous when displaying quickly moving images. Furthermore, it is essential to convert video signals from interlaced scanning to noninterlaced scanning in order to display an ordinary video input.

LCD display devices usually employ line inversion or dot inversion display techniques to prevent picture degradation due to mutual interference between accumulated charges (i.e., image information) in adjacent display elements. This requires an additional process of converting image information.

Higher-speed scanning is required as the display capacity of matrix display devices increases. As an example, the video graphics array (VGA) standard (640 by 480 pixels) requires a 9 MHz clock whereas the engineering workstation (EWS) standard requires a clock frequency of more than 30 MHz. Since the peripheral driving circuits of the matrix display devices formed in monolithic form are produced by the use of such a semiconductor material as polycrystalline silicon, which is inferior to single-crystal, an increase in operating speed is not preferable.

SUMMARY OF THE INVENTION

It is an object of the invention to provide a solution to at least one of the aforementioned problems of the prior art.

In one form of the invention, a display device comprises a plurality of display elements arranged on a substrate to form a matrix structure, and at least first and second row driving circuits for supplying signals to individual rows of the matrix structure, the row driving circuits being located separately from and parallel to each other on the same substrate as the matrix structure, wherein a signal for any row signal line adjacent to a given row signal line to which a signal is supplied from the first row driving circuit is supplied from other than the first row driving circuit.

The above defined display device may be constructed in such a way that one of the row driving circuits is located to the left of the matrix structure while another is located to the right of the matrix structure, or all the row driving circuits are located to the left or right of the matrix structure.

In another form of the invention, a display device comprises a plurality of display elements arranged on a substrate to form a matrix structure, and at least first and second column driving circuits for supplying signals to individual columns of the matrix structure, the column driving circuits being located separately from and parallel to each other on the same substrate as the matrix structure, wherein a signal for any column signal line adjacent to a given column signal line to which a signal is supplied from the first column driving circuit is supplied from other than the first column driving circuit.

Construction of this display device may be such that one of the column driving circuits is located above the upper edge of the matrix structure while another is located below the lower edge of the matrix structure, or all the column driving circuits is located above the upper edge or below the lower edge of the matrix structure.

In either form of the invention, the display device may be constructed in such a way that all the row driving and column driving circuits employ shift registers for use as addressing circuits, or all the row driving and column driving circuits employ decoders for use as addressing circuits. Alternatively, the construction of the display device may be such that each row driving circuit employs a shift register as an addressing circuit while each column driving circuit employs a decoder as an addressing circuit, or vice versa.

In a case where two or more row driving or column driving circuits employing shift registers as addressing circuits are provided separately from each other, the construction of the display device may be such that a select signal outputted from a last stage of the first driving circuit is entered to a first stage of the second driving circuit.

In a case where two or more row driving or column driving circuits employing decoders as addressing circuits are provided separately from each other, the construction of the display device may be such that these decoders are controlled by a common counter.

Where the display device comprises two or more column driving circuits, it may be constructed in such a way that signals for driving display elements in a plurality of columns of the matrix structure may be simultaneously supplied to the respective column signal lines.

In either the first or second form of the invention described above, it is possible to reduce the longitudinal dimension of each stage (to which each signal line is connected) of a driving circuit. If two column driving circuits are provided at separate sites from each other, for example, the number of column signal lines that branch out from each column driving circuit can be halved. This means that twice as many column signal lines can be laid by dividing a single column driving circuit into two, provided that the width of each signal line is unchanged. In other words, twice as many display elements (pixels) can be formed in a given surface area compared to the conventional matrix structure.

The aforementioned feature of the invention is described in more detail by way of example. Provided that the overall length of a column driving circuit of a conventional matrix display is 19.2 mm and 640 column signal lines branch out from the column driving circuit, the interval between successive column signal lines is 30 $\mu$m. In other words, each stage of the column driving circuit takes up a longitudinal dimension of 30 $\mu$m. If two such column driving circuits, designed with the same signal line intervals, are provided parallel to each other at separate sites according to the invention, the number of column signal lines is doubled. Specifically, a total of 1280 column signal lines branch out from the two column driving circuits so that the effective line-to-line interval becomes 15 $\mu$m, although the actual interval between the individual column signal lines branching out from each column driving circuit remains 30 $\mu$m. It is possible anyway to produce a matrix display of a larger scale.

In one variation of the invention, the length of each column driving circuit may be halved. Although the number of column signal lines that can be connected to each column driving circuit decreases to 320, the total number of column signal lines branching out from two column driving circuits remains 640. This results in a reduction in pixel dimensions and an increase in integration level. Three, four, or more separate column driving circuits may be provided to achieve three times, four times, or further higher integration level or larger matrix scale.

The above discussion also applies to the row driving circuits and row signal lines.

In another feature of the invention, it is possible to scan odd-numbered and even-numbered horizontal lines, or rows of display elements, in alternate vertical scans to perform interlaced scanning. This is achieved by configuring the first and second driving circuits in such a way that a select signal outputted from the last stage of the first driving circuit is entered to the first stage the second driving circuit in a case where the two driving circuits employ shift registers as addressing circuits. If the first and second driving circuits employ decoders as an addressing circuits, the decoders should be controlled by a common counter to perform interlaced scanning.

It is also possible to scan every second rows, every third rows, and so forth if there are provided three, four, or more separate column driving circuits and they are driven in a prescribed sequence.

On the other hand, video signals can be simultaneously supplied to a plurality of column driving circuits by driving them substantially at the same time (provided that there is no signal delay except for unavoidable delays caused by different wiring lengths, for instance). This makes it possible to reduce the operating frequency of the individual column driving circuits. As an example, if four column driving circuits are provided for driving a matrix display conforming to the VGA standard (640 horizontal lines), 160 column signal lines are to be connected to each column driving circuit and the operating frequency of each column driving circuit becomes 2.3 MHz, one-fourth the normal operating frequency.

Further, the foregoing another form of the invention where a given column signal line is supplied with a signal from a first column driving circuit and another column signal line adjacent to the given column signal line is supplied with a signal from a second column driving circuit can be used to supply a positive video signal and a negative video signal on the same display frame in line inversion, that is, polarities of video signals are different from each other between adjacent column signal lines by supplying the positive video signal from the first column driving circuit and supplying the negative video signal from the second column driving circuit. Dot inversion of the video signal polarity can also be performed easily in a similar way.

BRIEF DESCRIPTION OF THE DRAWINGS

FIG. 2A is a block diagram of a matrix display according to a second embodiment of the invention;

FIGS. 2B and 2C are simplified circuit diagrams illustrating alternative circuit configurations for driving individual display elements of the second embodiment;

FIG. 3A is a block diagram of a matrix display according to a third embodiment of the invention;

FIGS. 3B and 3C are simplified circuit diagrams illustrating alternative circuit configurations for driving individual display elements of the third embodiment;

FIG. 4A is a block diagram of a matrix display according to a fourth embodiment of the invention;

FIGS. 4B and 4C are simplified circuit diagrams illustrating alternative circuit configurations for driving individual display elements of the fourth embodiment;

DETAILED DESCRIPTION OF THE PREFERRED EMBODIMENTS

First Embodiment

Figure 1A:
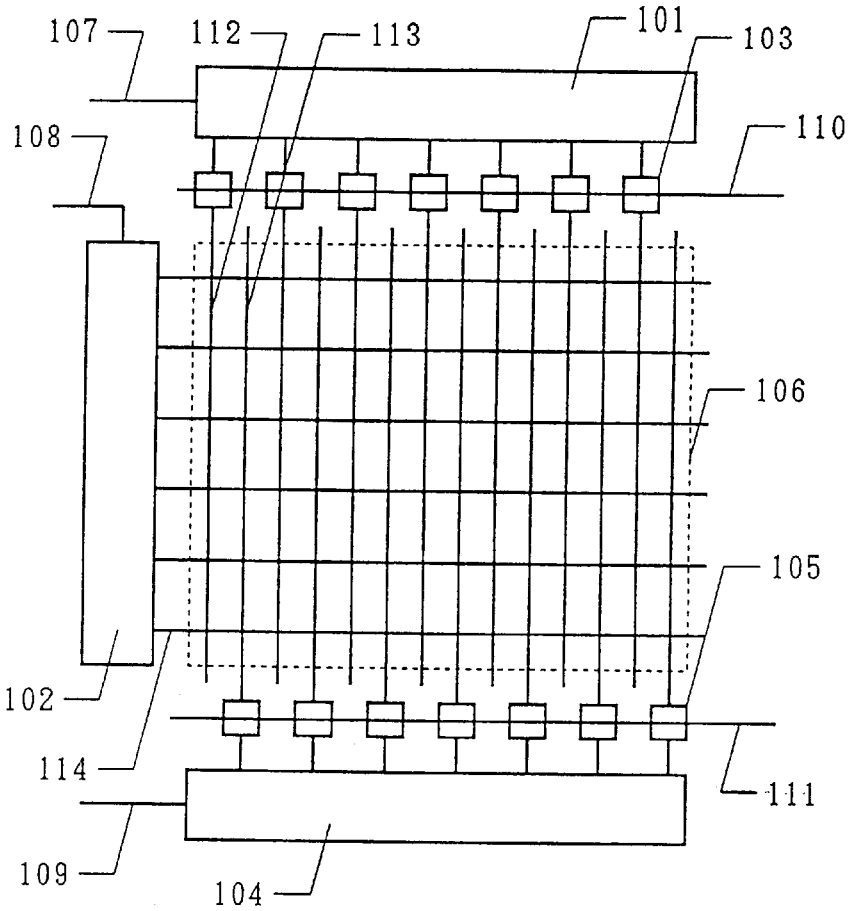
FIG. 1A is a block diagram of a matrix display according to a first embodiment of the invention.
Figure 1B:
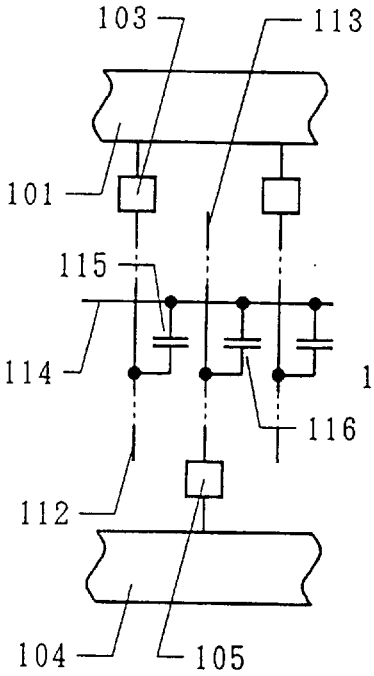
FIGS. 1B and 1C are simplified circuit diagrams illustrating alternative circuit configurations for driving individual display elements of the first embodiment.
Figure 1C:
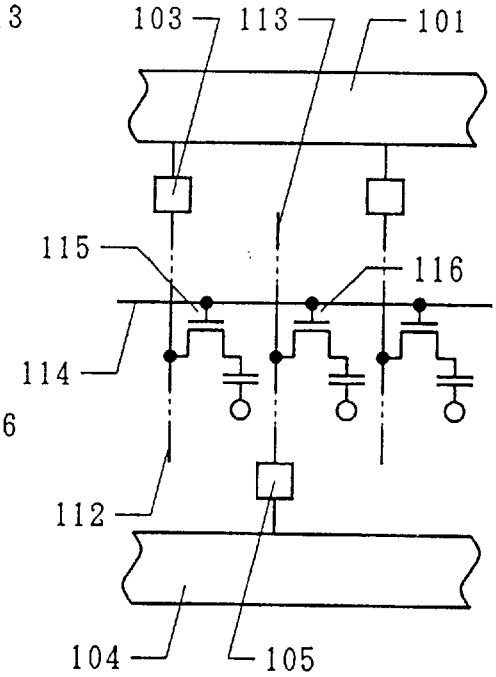

FIGS. 1A to 1C illustrate circuit configuration of a matrix display according to a first embodiment of the invention, in which FIG. 1A is a block diagram of the matrix display. Although the matrix display of this embodiment employs a matrix 106 of 6 rows by 14 columns for the sake of simplification, the embodiment is applicable to a larger matrix as well. As shown in FIG. 1A, there are provided a first column driving circuit 101 and a second column driving circuit 104 for driving the matrix 106. In this embodiment, the first column driving circuit 101 is located above the upper edge of the matrix 106 while the second column driving circuit 104 is located below the lower edge of the matrix 106, as illustrated in FIG. 1A. The first and second column driving circuits 101 and 104 are connected to individual column signal lines 112 and 113 via output circuits 103 and 105, respectively. On the other hand, a row driving circuit 102 supplies driving signals to individual row signal lines 114.

Referring to FIG. 1A, video signals are supplied to the first and second column driving circuits 101 and 104 via video signal lines 107 and 109, respectively, while a clock signal is supplied to the row driving circuit 102 via a clock signal line 108. Although not specifically illustrated, clock signals are supplied to the first and second column driving circuits 101 and 104 as well. The individual output circuits 103 and 105 are driven by latch pulse signals which are synchronized with the clock signal supplied to the individual row signal lines 114. Latch pulses are supplied to the output circuits 103 and 105 through latch signal lines 110 and 111, respectively.

FIGS. 1B and 1C are alternative circuit diagrams particularly showing connections between one row signal line 114 and three column signal lines 112, 113. In FIG. 1B which shows a simple matrix structure, display elements (pixels) 115 and 116 are formed at intersections of each row signal line 114 and column signal line 112, and of each row signal line 114 and column signal line 113, respectively. It is to be noted that signals for the individual column signal lines 112 are supplied from the first column driving circuit 101 whereas signals for the individual column signal lines 113 are supplied from the second column driving circuit 104.

FIG. 1C shows an active matrix structure in which transistors are employed as active devices. In this structure the relationship between the column signal lines 112, 113 and the column driving circuits 101, 104 is exactly same as what has been described with reference to FIG. 1B. However, each of the display elements (pixels) 115 and 116 comprises a transistor and a capacitive circuit element in FIG. 1C.

Figure 7A:
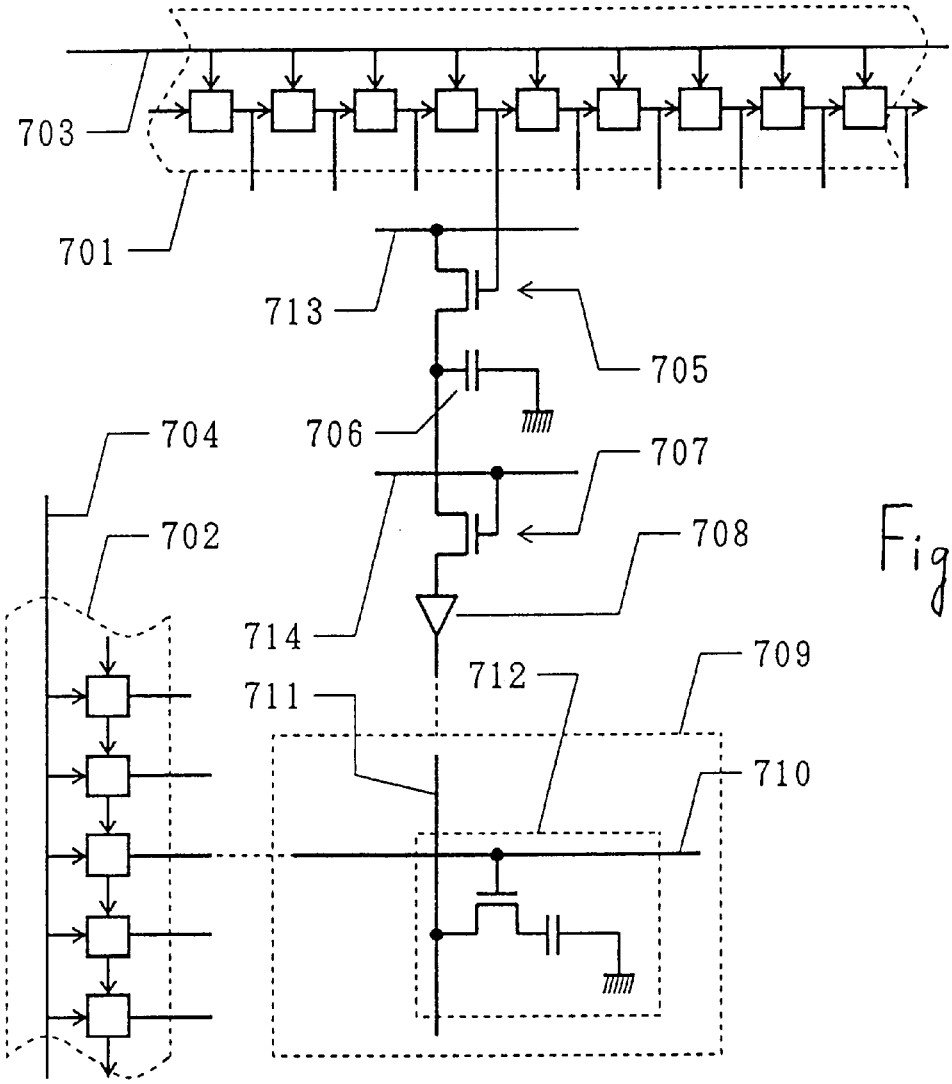
FIG. 7A illustrates a circuit configuration applicable for driving active matrix displays of the invention, in which row and column driving circuits comprise shift registers to constitute an addressing circuit.
Figure 7B:
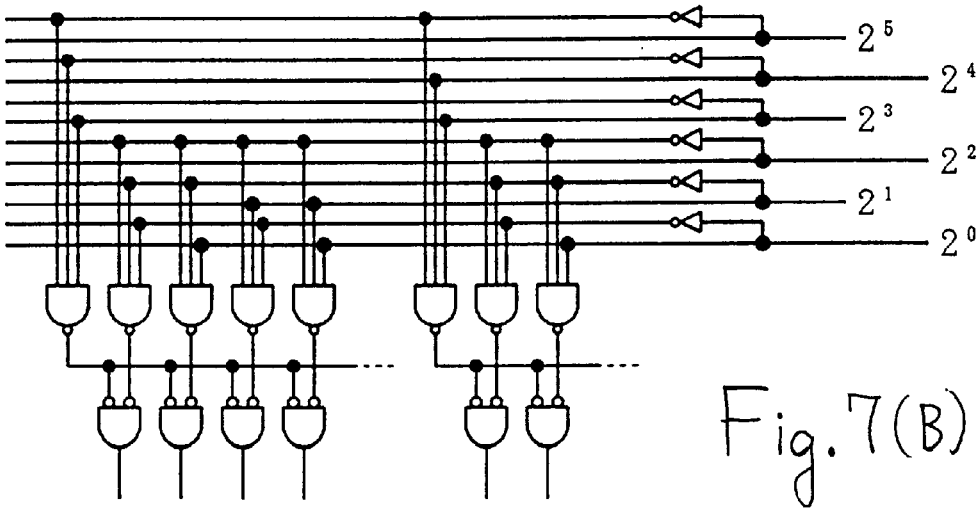
FIG. 7B illustrates a decoder which may substitute for either one or both of the shift registers shown in FIG. 7A.

FIGS. 7A and 7B are more detailed circuit diagrams illustrating circuit configurations for driving a matrix display device. More particularly, FIG. 7A shows a configuration in which row and column driving circuits comprise shift registers 701 and 702 to constitute an addressing circuit, whereas FIG. 7B shows a decoder which may substitute for either one or both of the shift registers 701 and 702 of FIG. 7A. The circuit configurations of FIGS. 7A and 7B are applicable not only to the first embodiment but also to other embodiments which will be described later.

Referring to FIG. 7A, clock pulses are supplied to the shift register 701 of the column driving circuit via a clock signal line 703 so that the shift register 701 outputs sequentially shifting signals. The column driving circuit comprises analog switches 705 and analog memories 706 in addition to the shift register 701. Video signals entered through video signal lines 713 are sampled by the analog switches 705 and held in the respective analog memories 706.

As switches 707 are turned on and off by a latch signal line 714 in a controlled manner, the video signals amplified by analog buffers 708 are supplied to individual column signal lines 711 of a matrix 709. In the example shown in FIG. 7A, the matrix 709 is an active matrix display device which employs transistors as active devices.

Clock pulses are supplied to the shift register 702 of the row driving circuit via a clock signal line 704 so that the shift register 702 outputs sequentially shifting signals. It is to be noted the clock pulses supplied to the shift register 702 are different from those supplied to the shift register 701. This is because the operating frequency of the row driving circuit is lower than that of the column driving circuit. The row driving circuit is constructed with the shift register 702 as described above.

Select signals outputted from the shift register 702 are supplied to row signal lines 710 arranged on the matrix 709. Since each row signal line 710 is connected to a gate of a transistor built in a display element (pixel) 712, a video signal held in the analog memory 706 on a particular column signal line 711 is entered to the corresponding display element (pixel) 712.

If it is desired to use a decoder as disclosed in Japanese Unexamined Patent Application No. 62-265696, the circuit shown in FIG. 7B could substitute for each of the shift registers 701 and 702 shown in FIG. 7A. In this embodiment, it is possible to substitute the decoder for only the column driving circuit or the row driving circuit.

Although the matrix driving circuit of FIGS. 7A and 7B is of an analog type employing the analog switches 705 and analog memories 706, an equivalent digital-type circuit can be easily configured by use of prior art digital techniques.

There are a total of 14 column signal lines 112, 113 in the first embodiment described above, and seven each column signal lines 112, 113 are connected to the first column driving circuit 101 and the second column driving circuit 104. It is possible to double the density of display elements (pixels) by providing two column driving circuits 101, 104 in this manner.

Second Embodiment

FIGS. 2A to 2C illustrate circuit configuration of a matrix display according to a second embodiment of the invention, in which FIG. 2A is a block diagram of the matrix display. The matrix display of this embodiment employs a matrix 206 of 6 rows by 14 columns for the sake of simplification. As shown in FIG. 2A, there are provided a first column driving circuit 201 and a second column driving circuit 202 for driving the matrix 206. In this embodiment, both the first column driving circuit 201 and the second column driving circuit 202 are located above the upper edge of the matrix 206, as illustrated in FIG. 2A. The first and second column driving circuits 201 and 202 are connected to individual column signal lines 214 and 213 via output circuits 203 and 204, respectively. On the other hand, a row driving circuit 205 supplies driving signals to individual row signal lines 212.

Referring to FIG. 2A, video signals are supplied to the first and second column driving circuits 201 and 202 via video signal lines 207 and 208, respectively, while a clock signal is supplied to the row driving circuit 205 via a clock signal line 209. Although not specifically illustrated, clock signals are supplied to the first and second column driving circuits 201 and 202 as well. The individual output circuits 203 and 204 are driven by latch pulse signals which are synchronized with the clock signal supplied to the individual row signal lines 212. Latch pulses are supplied to the output circuits 203 and 204 through latch signal lines 210 and 211, respectively.

FIGS. 2B and 2C are alternative circuit diagrams particularly showing connections between one row signal line 212 and three column signal lines 213, 214. In FIG. 2B which shows a simple matrix structure, display elements (pixels) 215 and 216 are formed at intersections of each row signal line 212 and column signal line 214, and of each row signal line 212 and column signal line 213, respectively. It is to be noted that signals for the individual column signal lines 214 are supplied from the first column driving circuit 201 whereas signals for the individual column signal lines 213 are supplied from the second column driving circuit 202.

FIG. 2C shows an active matrix structure in which transistors are employed as active devices. In this structure the relationship between the column signal lines 213, 214 and the column driving circuits 201, 202 is exactly same as what has been described with reference to FIG. 2B. However, each of the display elements (pixels) 215 and 216 comprises a transistor and a capacitive circuit element in FIG. 2C.

Third Embodiment

FIGS. 3A to 3C illustrate circuit configuration of a matrix display according to a third embodiment of the invention, in which FIG. 3A is a block diagram of the matrix display. The matrix display of this embodiment employs a matrix 305 of 11 rows by 7 columns for the sake of simplification. As shown in FIG. 3A, there are provided a first row driving circuit 303 and a second row driving circuit 304 for driving the matrix 305. In this embodiment, the first row driving circuit 303 is located to the left of the matrix 305 while the second row driving circuit 304 is located to the right of the matrix 305, as illustrated in FIG. 3A. Signals are supplied from the first and second row driving circuits 303 and 304 to individual row signal lines 312 and 311, respectively. On the other hand, a column driving circuit 301 supplies video signals to individual column signal lines 310 via respective output circuits 302.

Referring to FIG. 3A, a video signal is supplied to the column driving circuit 301 via a video signal line 306 while clock signals are supplied to the first and second row driving circuits 303 and 304 via clock signal lines 307 and 308, respectively. This configuration makes it easier to choose whether to sequentially scan all successive rows, or horizontal lines, in a single vertical scan (noninterlaced scanning) or to scan odd-numbered and even-numbered horizontal lines in alternate vertical scans (interlaced scanning) by controlling the timing of clock pulses fed through the clock signal lines 307 and 308. Although not specifically illustrated, a clock signal is supplied to the column driving circuit 301 as well. The individual output circuits 302 are driven by a latch pulse signal. Latch pulses are supplied to the output circuits 302 through a latch signal line 309.

FIGS. 3B and 3C are alternative circuit diagrams particularly showing connections between one column row signal line 310 and three row signal lines 311, 312. In FIG. 3B which shows a simple matrix structure, display elements (pixels) 313 and 314 are formed at intersections of each column signal line 310 and row signal line 311, and of each column signal line 310 and row signal line 312, respectively. It is to be noted that signals for the individual row signal lines 312 are supplied from the first row driving circuit 303 whereas signals for the individual row signal lines 311 are supplied from the second row driving circuit 304.

FIG. 3C shows an active matrix structure in which transistors are employed as active devices. In this structure the relationship between the row signal lines 311, 312 and the row driving circuits 303, 304 is exactly same as what has been described with reference to FIG. 3B. However, each of the display elements (pixels) 313 and 314 comprises a transistor and a capacitive circuit element in FIG. 3C.

Fourth Embodiment

FIGS. 4A to 4C illustrate circuit configuration of a matrix display according to a fourth embodiment of the invention, in which FIG. 4A is a block diagram of the matrix display. The matrix display of this embodiment employs a matrix 405 of 11 rows by 7 columns for the sake of simplification. As shown in FIG. 4A, there are provided a first row driving circuit 403 and a second row driving circuit 404 for driving the matrix 405. In this embodiment, both the first row driving circuit 403 and the second row driving circuit 404 are located to the left of the matrix 405, as illustrated in FIG. 4A. Signals are supplied from the first and second row driving circuits 403 and 404 to individual row signal lines 411 and 412, respectively. On the other hand, a column driving circuit 401 supplies video signals to individual column signal lines 410 via respective output circuits 402.

Referring to FIG. 4A, a video signal is supplied to the column driving circuit 401 via a video signal line 406 while clock signals are supplied to the first and second row driving circuits 403 and 404 via clock signal lines 407 and 408, respectively. This configuration makes it easier to choose whether to sequentially scan all successive rows, or horizontal lines, in a single vertical scan (noninterlaced scanning) or to scan odd-numbered and even-numbered horizontal lines in alternate vertical scans (interlaced scanning) by controlling the timing of clock pulses fed through the clock signal lines 407 and 408. Although not specifically illustrated, a clock signal is supplied to the column driving circuit 401 as well. The individual output circuits 402 are driven by a latch pulse signal. Latch pulses are supplied to the output circuits 402 through a latch signal line 409.

FIGS. 4B and 4C are alternative circuit diagrams particularly showing connections between one column signal line 410 and three row signal lines 411, 412. In FIG. 4B which shows a simple matrix structure, display elements (pixels) 413 and 414 are formed at intersections of each column signal line 410 and row signal line 411, and of each column signal line 410 and row signal line 412, respectively. It is to be noted that signals for the individual row signal lines 411 are supplied from the first row driving circuit 403 whereas signals for the individual row signal lines 412 are supplied from the second row driving circuit 404.

FIG. 4C shows an active matrix structure in which transistors are employed as active devices. In this structure the relationship between the row signal lines 411, 412 and the row driving circuits 403, 404 is exactly same as what has been described with reference to FIG. 4B. However, each of the display elements (pixels) 413 and 414 comprises a transistor and a capacitive circuit element in FIG. 4C.

Fifth Embodiment

Figure 5A:
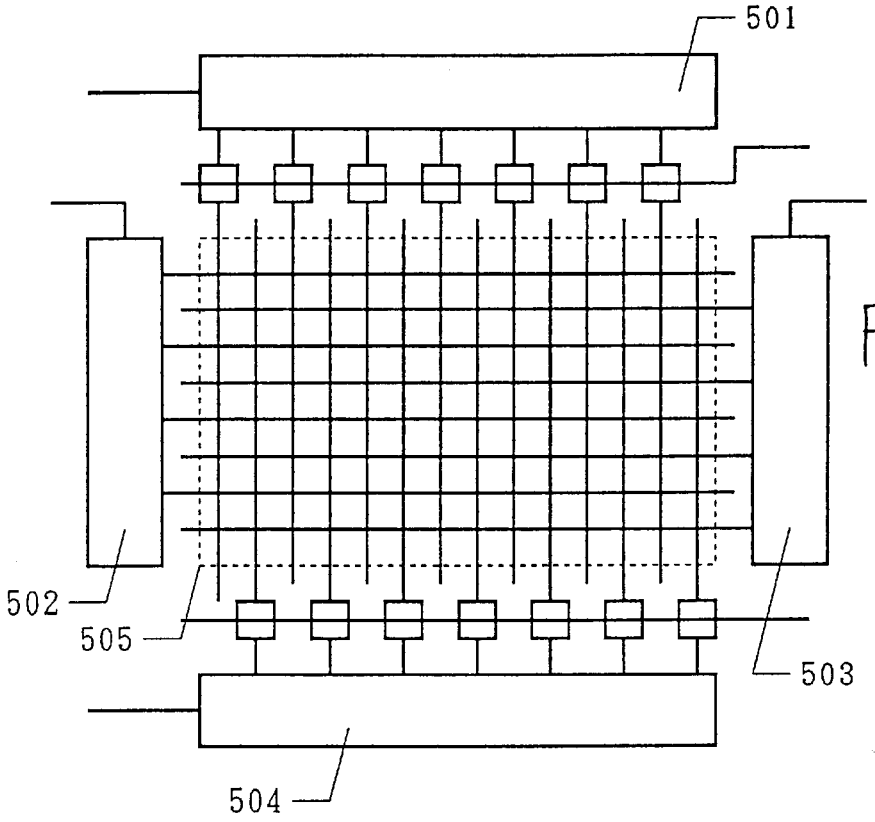
FIG. 5A is a block diagram of a matrix display according to a fifth embodiment of the invention.

FIG. 5A is a block diagram of a matrix display according to a fifth embodiment of the invention. The matrix display of this embodiment employs a matrix 505 of 8 rows by 14 columns for the sake of simplification. There are provided a first row driving circuit 502 and a second row driving circuit 503 for driving the matrix 505. In this embodiment, the first row driving circuit 502 is located to the left of the matrix 505 while the second row driving circuit 503 is located to the right of the matrix 505, as illustrated in FIG. 5A. Signals are supplied from the first and second row driving circuits 502 and 503 to individual row signal lines. On the other hand, a first column driving circuit 501 and a second column driving circuit 504 supply video signals to individual column signal lines via respective output circuits. In this embodiment, the first column driving circuit 501 is located above the upper edge of the matrix 505 while the second column driving circuit 504 is located below the lower edge of the matrix 505. The density of display elements (pixels) is quadrupled by separately providing two each row driving circuits 502, 503 and column driving circuits 501, 504 in this manner.

Sixth Embodiment

Figure 5B:
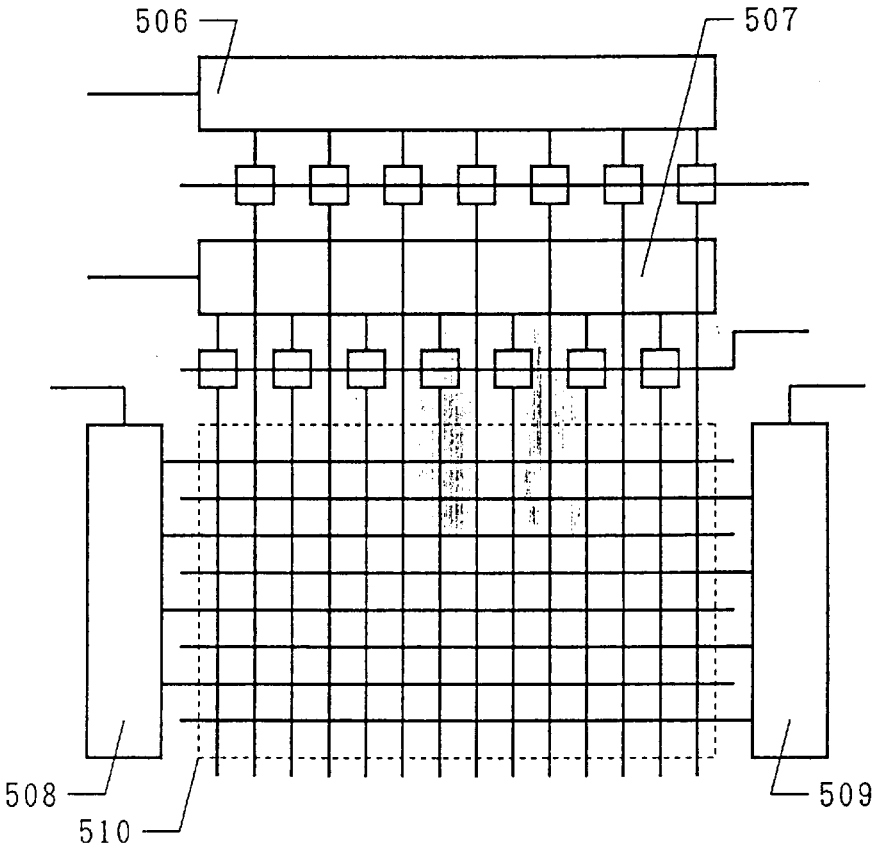
FIG. 5B is a block diagram of a matrix display according to a sixth embodiment of the invention.

FIG. 5B is a block diagram of a matrix display according to a sixth embodiment of the invention. The matrix display of this embodiment employs a matrix 510 of 8 rows by 14 columns for the sake of simplification. There are provided a first row driving circuit 508 and a second row driving circuit 509 for driving the matrix 510. In this embodiment, the first row driving circuit 508 is located to the left of the matrix 510 while the second row driving circuit 509 is located to the right of the matrix 510, as illustrated in FIG. 5B. Signals are supplied from the first and second row driving circuits 508 and 509 to individual row signal lines. On the other hand, a first column driving circuit 506 and a second column driving circuit 507 supply video signals to individual column signal lines via respective output circuits. In this embodiment, both the first column driving circuit 506 and the second column driving circuit 507 are located above the upper edge of the matrix 510.

Seventh Embodiment

Figure 6A:
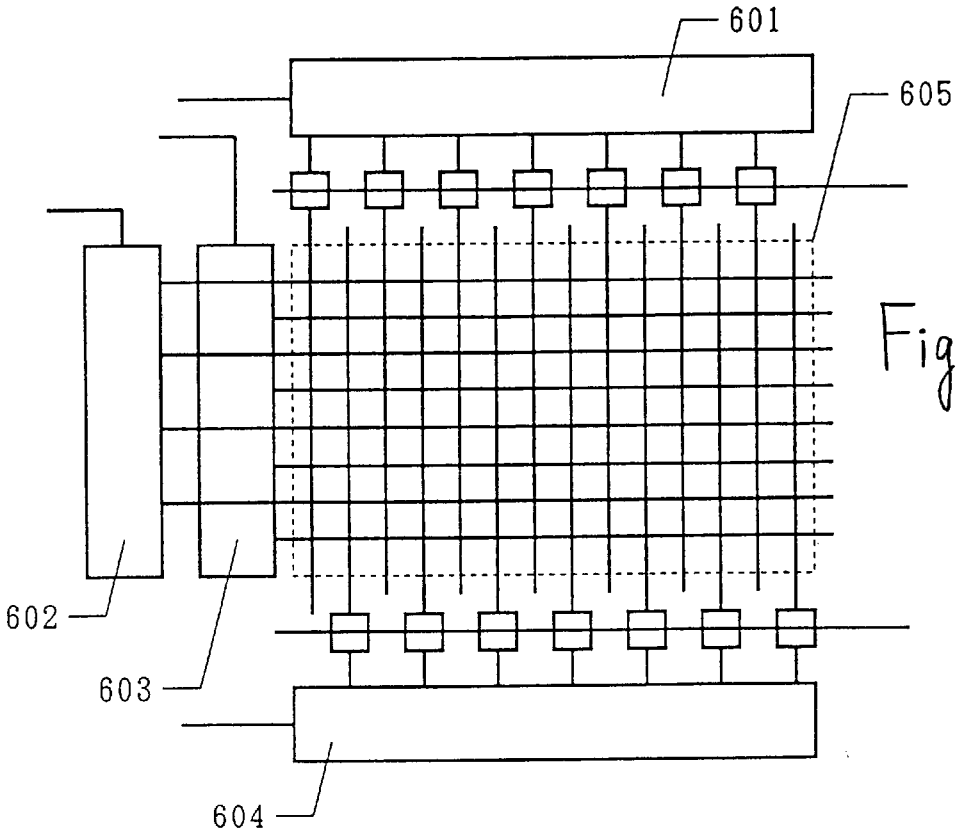
FIG. 6A is a block diagram of a matrix display according to a seventh embodiment of the invention.

FIG. 6A is a block diagram of a matrix display according to a seventh embodiment of the invention. The matrix display of this embodiment employs a matrix 605 of 8 rows by 14 columns for the sake of simplification. There are provided a first row driving circuit 602 and a second row driving circuit 603 for driving the matrix 605. In this embodiment, both the first row driving circuit 602 and the second row driving circuit 603 are located to the left of the matrix 605, as illustrated in FIG. 6A. Signals are supplied from the first and second row driving circuits 602 and 603 to individual row signal lines. On the other hand, a first column driving circuit 601 and a second column driving circuit 604 supply video signals to individual column signal lines via respective output circuits. In this embodiment, the first column driving circuit 601 is located above the upper edge of the matrix 605 while the second column driving circuit 604 is located below the lower edge of the matrix 605.

Eighth Embodiment

Figure 6B:
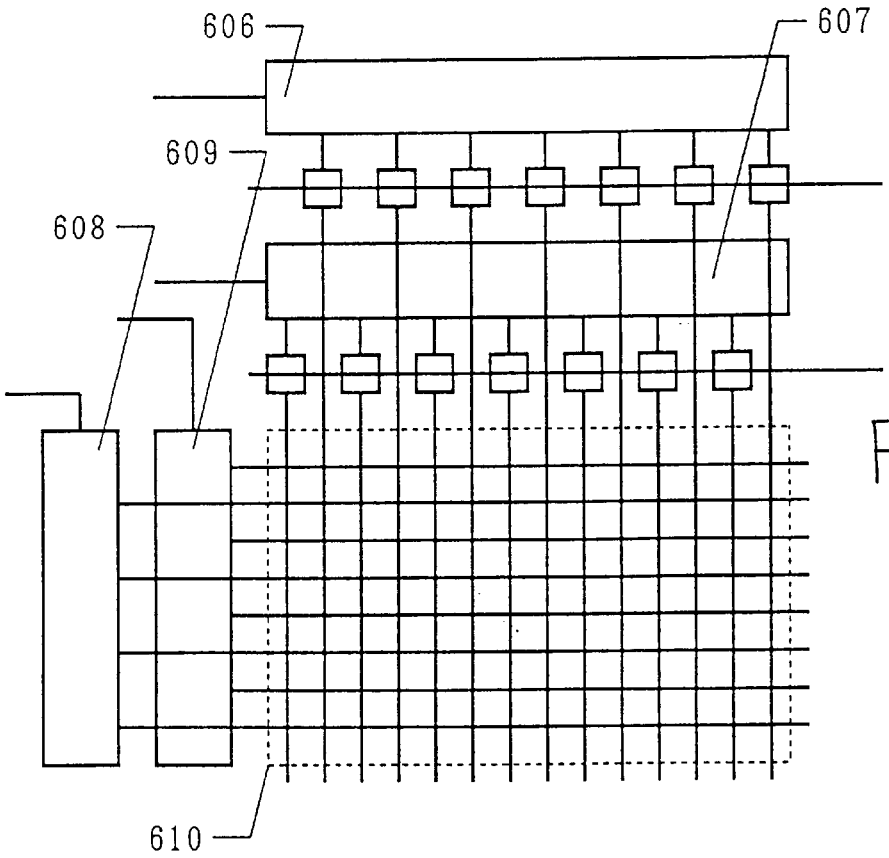
FIG. 6B is a block diagram of a matrix display according to an eighth embodiment of the invention.

FIG. 6B is a block diagram of a matrix display according to an eighth embodiment of the invention. The matrix display of this embodiment employs a matrix 610 of 8 rows by 14 columns for the sake of simplification. There are provided a first row driving circuit 608 and a second row driving circuit 609 for driving the matrix 610. In this embodiment, both the first row driving circuit 608 and the second row driving circuit 609 are located to the left of the matrix 610, as illustrated in FIG. 6B. Signals are supplied from the first and second row driving circuits 608 and 609 to individual row signal lines. On the other hand, a first column driving circuit 606 and a second column driving circuit 607 supply video signals to individual column signal lines via respective output circuits. In this embodiment, both the first column driving circuit 606 and the second column driving circuit 607 are located above the upper edge of the matrix 610.

Ninth Embodiment

Figure 8A:
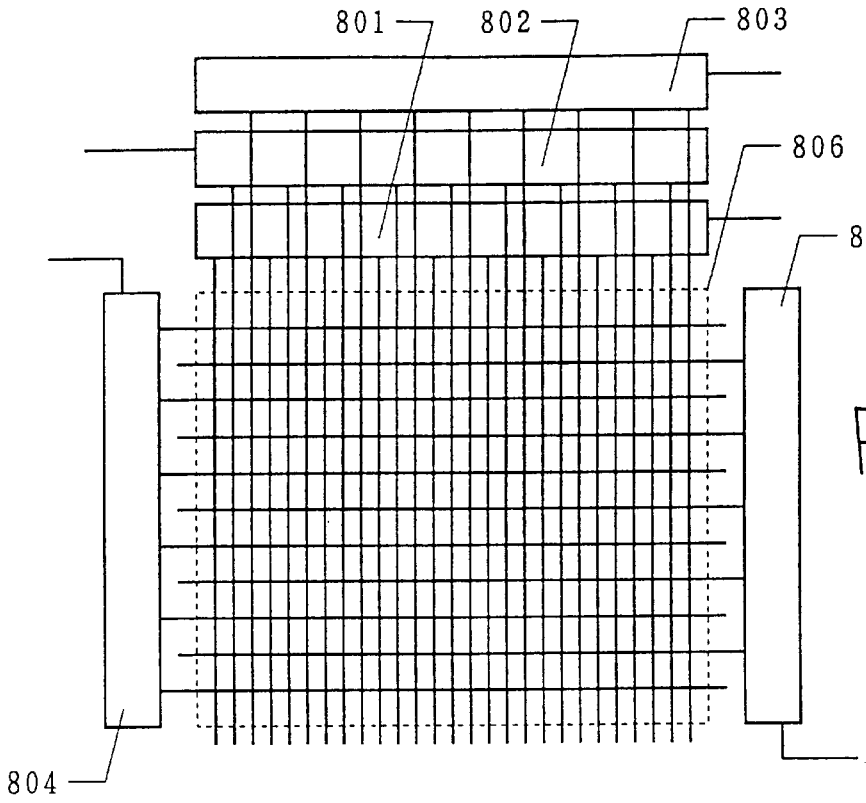
FIG. 8A is a block diagram of a matrix display according to a ninth embodiment of the invention.

FIG. 8A is a block diagram of a matrix display according to a ninth embodiment of the invention. The matrix display of this embodiment employs a matrix 806 of 11 rows by 27 columns for the sake of simplification. There are provided a first row driving circuit 804 and a second row driving circuit 805 for driving the matrix 806. In this embodiment, the first row driving circuit 804 is located to the left of the matrix 806 while the second row driving circuit 805 is located to the right of the matrix 806, as illustrated in FIG. 8A. Signals are supplied from the first and second row driving circuits 804 and 805 to individual row signal lines. On the other hand, a first column driving circuit 801, a second column driving circuit 802 and a third column driving circuit 803 supply video signals to individual column signal lines via respective output circuits (not shown). In this embodiment, all the column driving circuits 801–803 are located above the upper edge of the matrix 806. According to this circuit configuration, the operating frequency of the individual column driving circuits 801–803 can be made one-third as low as the normal operating frequency by simultaneously driving the three column driving circuits 801–803 and feeding different video signals to them.

Tenth Embodiment

Figure 8B:
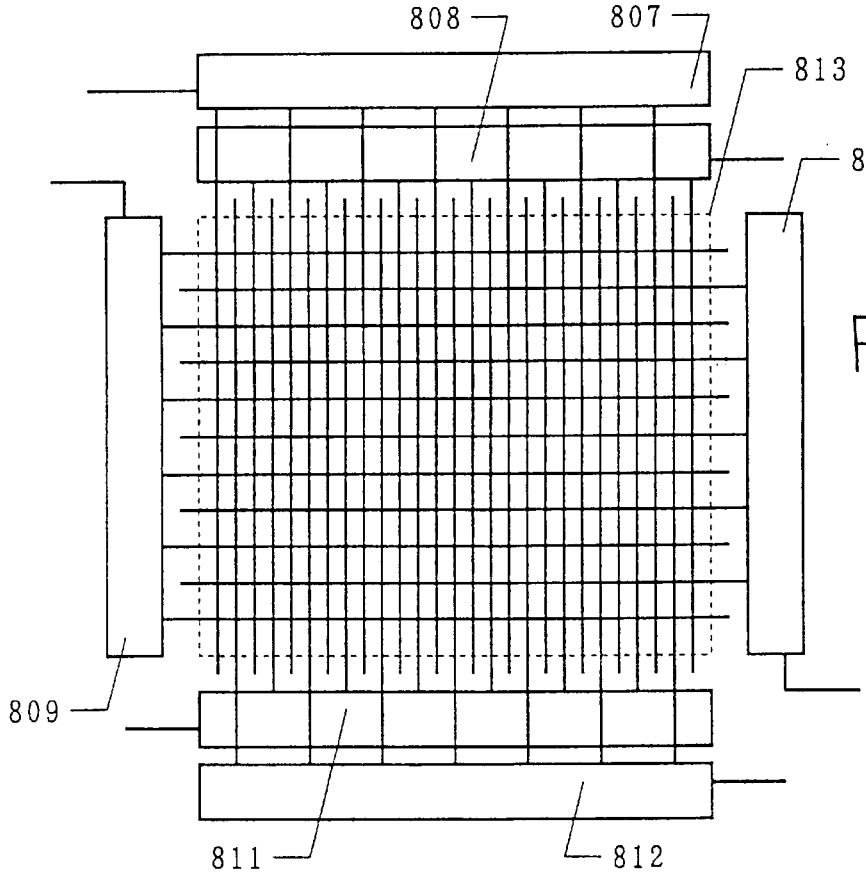
FIG. 8B is a block diagram of a matrix display according to a tenth embodiment of the invention.

FIG. 8B is a block diagram of a matrix display according to a tenth embodiment of the invention. The matrix display of this embodiment employs a matrix 813 of 11 rows by 27 columns for the sake of simplification. There are provided a first row driving circuit 809 and a second row driving circuit 810 for driving the matrix 813. In this embodiment, the first row driving circuit 809 is located to the left of the matrix 813 while the second row driving circuit 810 is located to the right of the matrix 813, as illustrated in FIG. 8B. Signals are supplied from the first and second row driving circuits 809 and 810 to individual row signal lines. On the other hand, a first column driving circuit 807, a second column driving circuit 808, a third column driving circuit 811 and a four the column driving circuit 812 supply video signals to individual column signal lines via respective output circuits (not shown). In this embodiment, the first column driving circuit 807 and the second column driving circuit 808 are located above the upper edge of the matrix 813 while the third column driving circuit 811 and the fourth column driving circuit 812 are located below the lower edge of the matrix 813. According to this circuit configuration, the operating frequency of the individual column driving circuits 807, 808, 811, 812 can be made one-fourth as low as the normal operating frequency by simultaneously driving the four column driving circuits 807, 808, 811, 812 and feeding different video signals to them.

Eleventh Embodiment

Referring now to FIGS. 9 to 12, a method of line inversion according to an eleventh embodiment of the invention is described. FIG. 9A shows a video signal for a particular row of a matrix display. A conventional technique used for line inversion of this type of video signal input which has a relatively featureless pattern involves a process of converting the video signal input so that its polarity is alternately inverted as shown in FIG. 9B. Sequentially varying values of the video signal are entered to a matrix addressing circuit and distributed to successive columns a through z. The present invention remarkably simplifies polarity inverting operation.

According to the eleventh embodiment, the video signal for a single row of the matrix display is compressed, or shortened in time, to half the original length. This compressed video signal in its normal polarity is combined with a reversal of the same video signal so that the former is immediately followed by the latter, as shown in FIG. 9C.

Figure 9A:
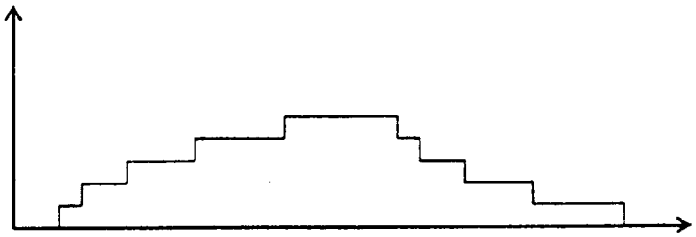
FIGS. 9A to 9E are diagrams illustrating how line inversion of a video signal is performed according to an eleventh embodiment.
Figure 9B:
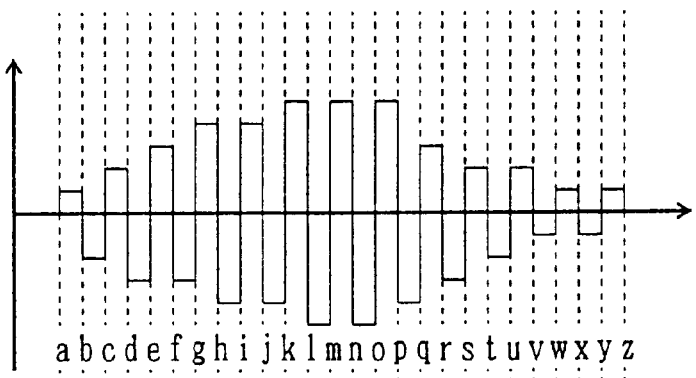
Figure 9C:
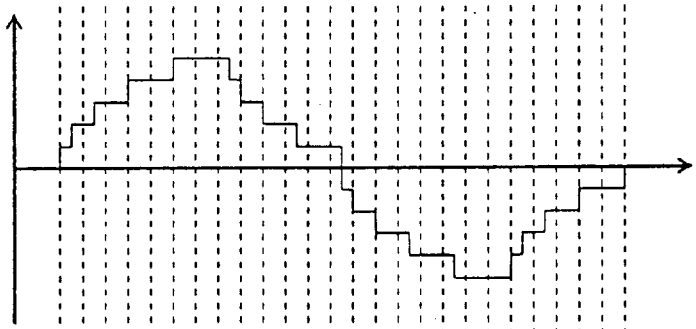
Figure 9D:
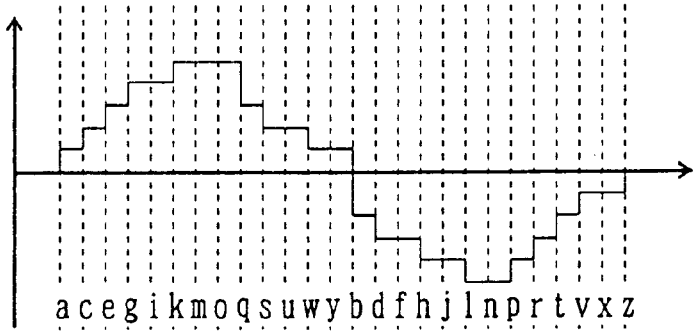
Figure 10A:
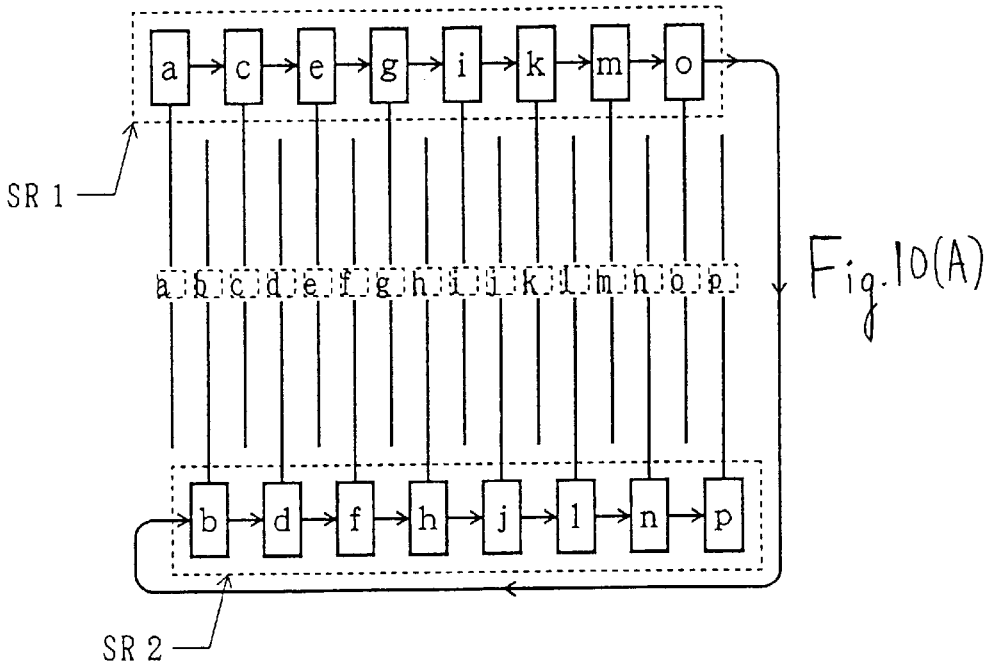
FIG. 10A is a simplified circuit diagram of an addressing circuit according to the eleventh embodiment.

As the resultant video signal input shown in FIG. 9C is sampled at specific points in time, a signal shown in FIG. 9D is obtained. The input signal thus obtained is entered to a shift register which is configured as shown in FIG. 10A, for instance, to distribute individual values of the video signal to successive columns of the matrix display. Although the matrix display shown in FIG. 10A has only 16 columns (a through p) for the sake of simplification, it may be expanded to include 26 columns (a through z), for instance. What is to be noted in the circuit configuration of FIG. 10A is that a select signal output from a last stage (column o) of a first shift register SRI is entered to a first stage (column b) of a second shift register SR2.

Figure 9E:
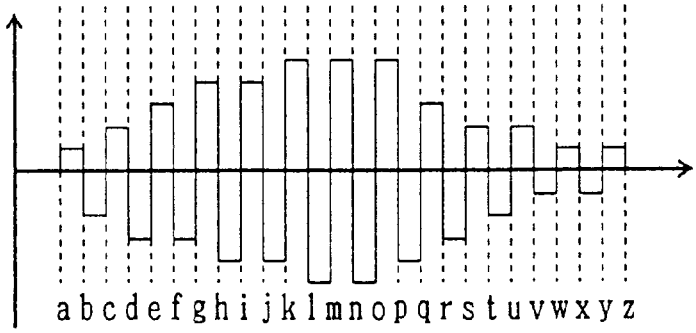

Referring to FIG. 10A, the matrix display comprises successive columns a, b, c, d, e, and so forth but the first shift register SR1 and the second shift register SR2 are alternately connected to these columns. Accordingly, if the individual values of the video signal shown in FIG. 9D are distributed to successive stages of the first shift register SR1 and the second shift register SR2, the signal entered to a given row of the matrix is depicted as shown in FIG. 9E. This is exactly the same as obtained by the conventional line inversion technique. It would be recognized from the above discussion of the embodiment that line inversion operation is remarkably simplified by the invention.

Figure 10B:
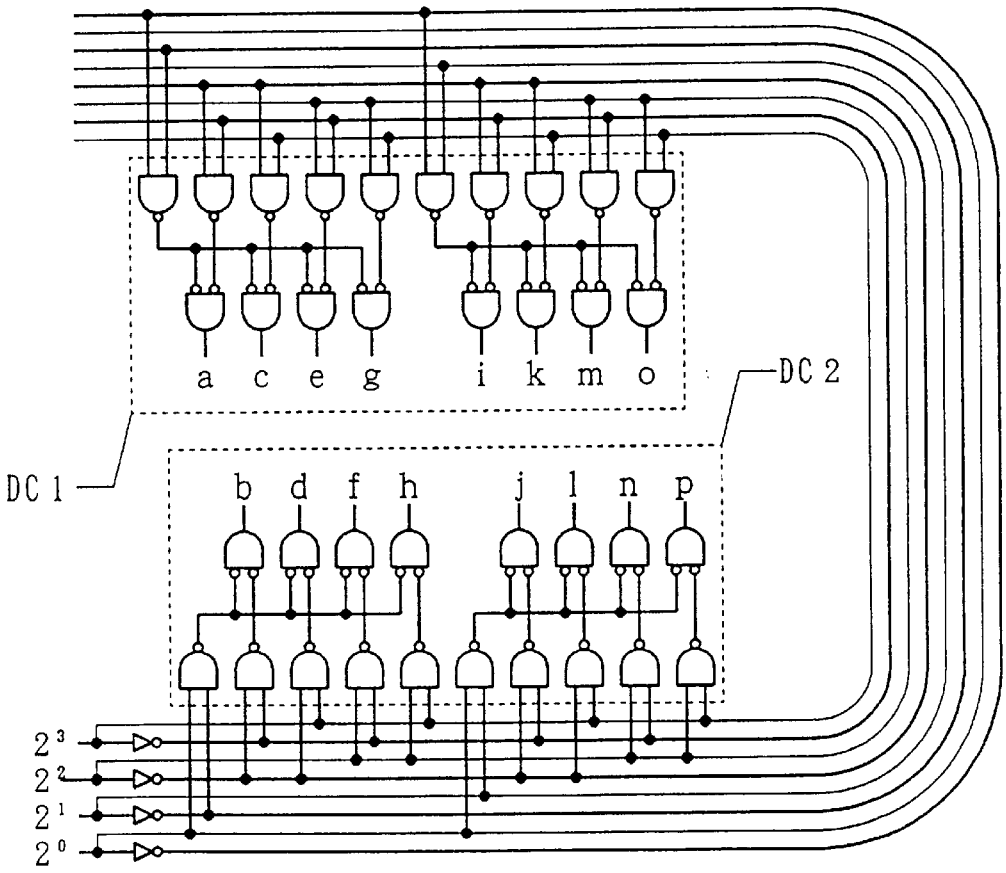
FIG. 10B is a circuit diagram of decoders which may substitute for shift registers shown in FIG. 10A.

Although the foregoing discussion is based on the circuit diagram of FIG. 10A which employs the shift registers SR1 and SR2 to constitute an addressing circuit, decoders DC1 and DC2 as shown in FIG. 10B which may substitute for the shift registers SR1 and SR2. Although a counter for the circuit of FIG. 10B outputs four digital values, or four bits designated by $2^0$ to $2^3$, to deliver signals to 16 columns, this is just for simplifying the circuit diagram. It is possible to drive a 26-column matrix display only by expanding the circuit of FIG. 10B so that it can handle one more bit.

Figure 11:
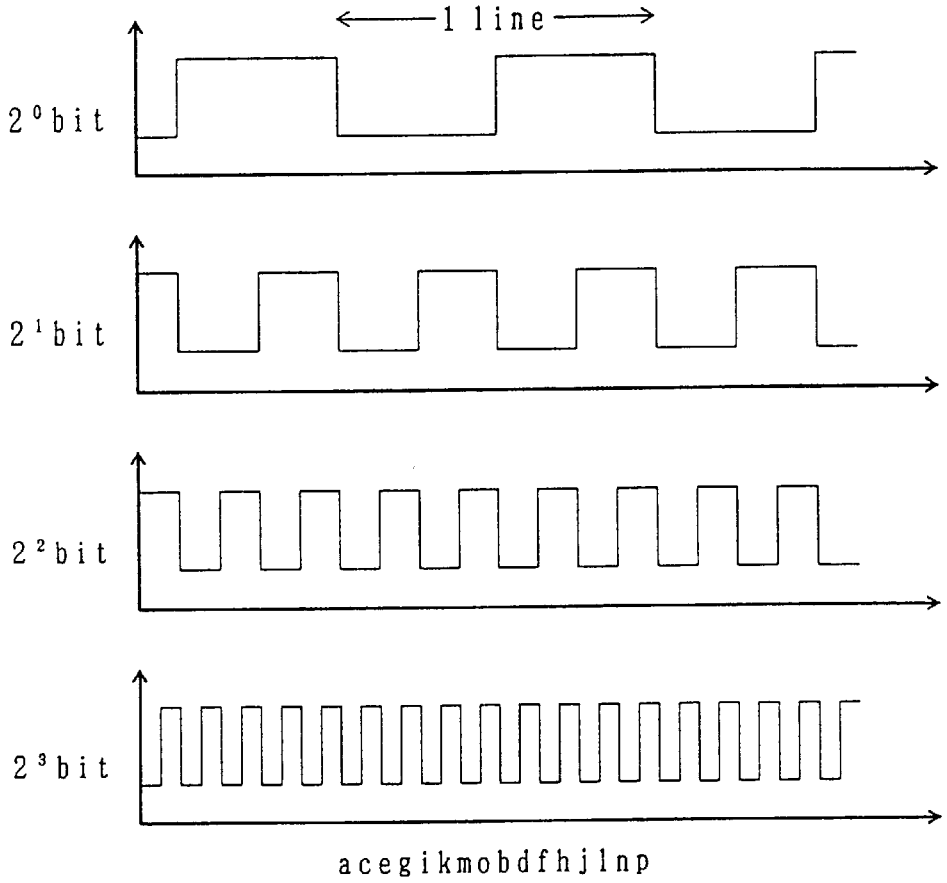
FIG. 11 is a diagram illustrating signals which may be entered to the decoder shown in FIG. 10B.

When signals shown in FIG. 11 are entered to individual bit lines $2^0$ to $2^3$ of the circuit of FIG. 10B, the first decoder DC1 sequentially outputs signals for columns a, c, e, g, i, k, m and o and then the second decoder DC2 sequentially outputs signals for columns b, d, f, h, j, l, n and p. This means that the first and second decoders DC1 and DC2 perform the same function as the first and second shift registers SR1 and SR2 shown in FIG. 10A.

Figure 12:
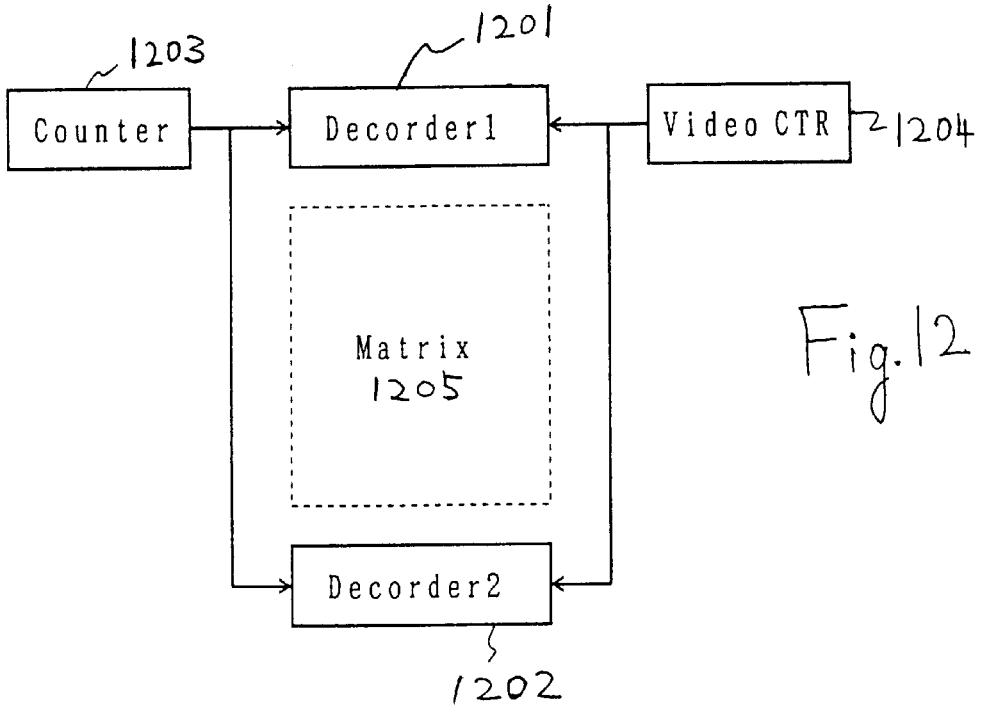
FIG. 12 is a block diagram of a matrix display according to the eleventh embodiment employing decoders to constitute an addressing circuit.

FIG. 12 is a block diagram of a matrix display based on the above-described line inversion operation. Although there are provided separate decoders 1201 and 1202, they are driven by a single counter 1203. The matrix display driving circuit of FIG. 12 is characterized in that line inversion operation is performed by supplying a video signal from a video controller 1204 to a matrix 1205.

What is claimed is:

1. An electro-optical device comprising:

a first data driver circuit provided over said substrate and comprising at least a first shift register;

a second data driver circuit provided over said substrate and comprising at least a second shift register;

a plurality of data signal odd-numbered lines provided over said substrate and branching out from said first data driver circuit, said data signal odd-numbered lines arranged on odd-numbered columns, respectively;

a plurality of data signal even-numbered lines provided over said substrate and branching out from said second data driver circuit, said data signal even-numbered lines arranged on even-numbered columns, respectively;

at least one pixel thin film transistor provided over said substrate in an active matrix and having a source region and a drain region one of which is connected to a corresponding one of said data signal odd-numbered lines; and at least one other pixel thin film transistor provided over said substrate in said active matrix and having a source region and a drain region one of which is connected to a corresponding one of said data signal even-numbered lines, wherein said data signal odd-numbered lines and said data signal even-numbered lines are arranged alternatively with a line space of 100 $\mu$m or less between two adjacent lines thereof, and wherein first video signals for pixels arranged on a row are processed into second video signals shortened to half time length of said first video signals, wherein said second video signals are distributed to said data signal odd-numbered lines through said first shift register, wherein third video signals having an inverted waveform of said second video signals and having an opposite polarity to said second video signals are distributed to said data signal even-numbered lines through said second shift register, and wherein a select signal output from a last stage of said first shift register is entered to a first stage of said second shift register to conduct a line inversion in which said third video signals have the opposite polarity to said second video signals.

2. The device of claim 1 wherein said active matrix and said two data driver circuits are integrated over said substrate.

3. The device of claim 1 wherein said device is an electroluminescent display.

4. A semiconductor device comprising:

a substrate;

a first data driving circuit provided over said substrate and comprising at least a first shift register;

a second data driving circuit provided over said substrate and comprising at least a second shift register;

a plurality of data signal odd-numbered lines provided over said substrate and branching out from said first data driver circuit, said data signal odd-numbered lines arranged on odd-numbered columns, respectively;

a plurality of data signal even-numbered lines provided over said substrate and branching out from said second data driver circuit, said data signal even-numbered lines arranged on even-numbered columns, respectively;

at least one pixel thin film transistor provided over said substrate in an active matrix and having a source region and a drain region one of which is connected to a corresponding one of said data signal odd-numbered lines; and at least one other pixel thin film transistor provided over said substrate in said active matrix and having a source region and a drain region one of which is connected to a corresponding one of said data signal even-numbered lines, wherein first video signals for pixels arranged on a row are processed into second video signals shortened to half time length of said first video signals, wherein said second video signals are distributed to said data signal odd-numbered lines through said first shift register, wherein third video signals having an inverted waveform of said second video signals and having an opposite polarity to said second video signals are distributed to said data signal even-numbered lines through said second shift register, and wherein a select signal output from a last stage of said first shift register is entered to a first stage of said second shift register to conduct a line inversion in which said third video signals have the opposite polarity to said second video signals.

5. The device of claim 4 wherein said semiconductor device comprises a liquid crystal display.

6. The device of claim 4 wherein said semiconductor device comprises an electroluminescent display.

7. A semiconductor device comprising:

a substrate;

a first data driving circuit provided over said substrate and comprising at least a first shift register;

a second data driving circuit provided over said substrate and comprising at least a second shift register;

a plurality of data signal odd-numbered lines provided over said substrate and branching out from said first data driver circuit, said data signal odd-numbered lines arranged on odd-numbered columns, respectively;

a plurality of data signal even-numbered lines provided over said substrate and branching out from said second data driver circuit, said data signal even-numbered lines arranged on even-numbered columns, respectively;

at least one pixel thin film transistor provided over said substrate in an active matrix and having a source region and a drain region one of which is connected to a corresponding one of said data signal odd-numbered lines; and at least one other pixel thin film transistor provided over said substrate in said active matrix and having a source region and a drain region one of which is connected to a corresponding one of said data signal even-numbered lines; and a gate line provided over said substrate, wherein first video signals for pixels arranged on a row are processed into second video signals shortened to half time length of said first video signals, wherein said second video signals are distributed to said data signal odd-numbered lines through said first shift register, wherein third video signals having an inverted waveform of said second video signals and having an opposite polarity to said second video signals are distributed to said data signal even-numbered lines through said second shift register, and wherein a select signal output from a last stage of said first shift register is entered to a first stage of said second shift register to conduct a line inversion in which said third video signals have the opposite polarity to said second video signals.

8. The device of claim 7 wherein said semiconductor device comprises a liquid crystal display.

9. The device of claim 7 wherein said semiconductor device comprises an electroluminescent display.

10. A semiconductor device comprising:

a substrate;

a first data driving circuit provided over said substrate and comprising at least a first shift register;

a second data driving circuit provided over said substrate and comprising at least a second shift register;

a plurality of data signal odd-numbered lines provided over said substrate and branching out from said first data driver circuit, said data signal odd-numbered lines arranged on odd-numbered columns, respectively;

a plurality of data signal even-numbered lines provided over said substrate and branching out from said second data driver circuit, said data signal even-numbered lines arranged on even-numbered columns, respectively;

at least one pixel thin film transistor provided over said substrate in an active matrix and having a source region and a drain region one of which is connected to a corresponding one of said data signal odd-numbered lines; and at least one other pixel thin film transistor provided over said substrate in said active matrix and having a source region and a drain region one of which is connected to a corresponding one of said data signal even-numbered lines, wherein first video signals for pixels arranged on a row are processed into second video signals shortened to half time length of said first video signals, wherein said second video signals are distributed to said data signal odd-numbered lines through said first shift register, wherein third video signals having an inverted waveform of said second video signals and having an opposite polarity to said second video signals are distributed to said data signal even-numbered lines through said second shift register, wherein a select signal output from a last stage of said first shift register is entered to a first stage of said second shift register to conduct a line inversion in which said third video signals have the opposite polarity to said second video signals, and wherein said active matrix is scanned in an interlace manner.

11. A semiconductor device comprising:

a substrate;

a first data driving circuit provided over said substrate and comprising at least a first shift register;

a second data driving circuit provided over said substrate and comprising at least a second shift register;

a plurality of data signal odd-numbered lines provided over said substrate and branching out from said first data driver circuit, said data signal odd-numbered lines arranged on odd-numbered columns, respectively;

a plurality of data signal even-numbered lines provided over said substrate and branching out from said second data driver circuit, said data signal even-numbered lines arranged on even-numbered columns, respectively;

at least one pixel thin film transistor provided over said substrate in an active matrix and having a source region and a drain region one of which is connected to a corresponding one of said data signal odd-numbered lines; and at least one other pixel thin film transistor provided over said substrate in said active matrix and having a source region and a drain region one of which is connected to a corresponding one of said data signal even-numbered lines, wherein first video signals for pixels arranged on a row are processed into second video signals shortened to half time length of said first video signals, wherein said second video signals are distributed to said data signal odd-numbered lines through said first shift register, wherein third video signals having an inverted waveform of said second video signals and having an opposite polarity to said second video signals are distributed to said data signal even-numbered lines through said second shift register, wherein a select signal output from a last stage of said first shift register is entered to a first stage of said second shift register to conduct a line inversion in which said third video signals have the opposite polarity to said second video signals, and wherein said active matrix is scanned in a non-interlace manner.

12. A semiconductor device comprising:

a substrate;

a first data driving circuit provided over said substrate and comprising at least a first shift register;

a second data driving circuit provided over said substrate and comprising at least a second shift register;

a plurality of data signal odd-numbered lines provided over said substrate and branching out from said first data driver circuit, said data signal odd-numbered lines arranged on odd-numbered columns, respectively;

a plurality of data signal even-numbered lines provided over said substrate and branching out from said second data driver circuit, said data signal even-numbered lines arranged on even-numbered columns, respectively;

at least one pixel thin film transistor provided over said substrate in an active matrix and having a source region and a drain region one of which is connected to a corresponding one of said data signal odd-numbered lines; and at least one other pixel thin film transistor provided over said substrate in said active matrix and having a source region and a drain region one of which is connected to a corresponding one of said data signal even-numbered lines, wherein first video signals for pixels arranged on a row are processed into second video signals shortened to half time length of said first video signals, wherein said second video signals are distributed to said data signal odd-numbered lines through said first shift register, wherein third video signals having an inverted waveform of said second video signals and having an opposite polarity to said second video signals are distributed to said data signal even-numbered lines through said second shift register, wherein a select signal output from a last stage of said first shift register is entered to a first stage of said second shift register to conduct a line inversion in which said third video signals have the opposite polarity to said second video signals, and wherein said first data driving circuit is provided on opposite side of said active matrix to said second data driving circuit.

* * * * *